US011545792B2

(12) United States Patent
Chang et al.

(10) Patent No.: US 11,545,792 B2
(45) Date of Patent: Jan. 3, 2023

(54) ELECTRICAL PLUG CONNECTOR WITH GROUNDING MEMBERS HAVING INTEGRATED FIRST AND SECOND CURVED CONTACT PORTIONS FOR EFFECTIVE GROUND CONNECTIONS

(71) Applicant: ADVANCED-CONNECTEK INC., New Taipei (TW)

(72) Inventors: Ming-Yung Chang, New Taipei (TW); Chia-Cheng He, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 17/170,355

(22) Filed: Feb. 8, 2021

(65) Prior Publication Data

US 2021/0257789 A1 Aug. 19, 2021

Related U.S. Application Data

(60) Provisional application No. 62/975,793, filed on Feb. 13, 2020.

(30) Foreign Application Priority Data

Jan. 7, 2021 (TW) ..... 110200221

(51) Int. Cl.

| | |
|---|---|
| ***H01R 13/6597*** | (2011.01) |
| ***H01R 13/26*** | (2006.01) |
| ***H01R 13/6585*** | (2011.01) |
| ***H01R 13/502*** | (2006.01) |

(52) U.S. Cl.
CPC ..... *H01R 13/6597* (2013.01); *H01R 13/26* (2013.01); *H01R 13/502* (2013.01); *H01R 13/6585* (2013.01)

(58) Field of Classification Search
CPC .. H01R 13/6597; H01R 13/26; H01R 13/502; H01R 13/6585; H01R 13/658; H01R 13/6586
USPC ..... 439/607.05
See application file for complete search history.

(56) References Cited

U.S. PATENT DOCUMENTS

| | | | | |
|---|---|---|---|---|
| 9,450,342 | B2 * | 9/2016 | Wu | H01R 13/6593 |
| 9,627,817 | B2 * | 4/2017 | Chang | H01R 13/6594 |
| 9,647,395 | B2 * | 5/2017 | Hsu | H01R 13/405 |
| 9,960,551 | B2 * | 5/2018 | Tsai | H01R 24/64 |

(Continued)

FOREIGN PATENT DOCUMENTS

| | | | | |
|---|---|---|---|---|
| CN | 204304114 U | * | 4/2015 | |
| CN | 206595497 U | * | 10/2017 | H01R 13/04 |

*Primary Examiner* — Peter G Leigh
(74) *Attorney, Agent, or Firm* — Muncy, Geissler, Olds & Lowe, P C.

(57) ABSTRACT

An electrical plug connector includes a metallic shell, an insulated member, plug terminals, and grounding members. The insulated member is in the metallic shell. The plug terminals are held in the insulated member. The grounding members and the insulated member are molded as a one-piece member, thereby reducing the production steps as well as reducing production of defect products. Moreover, the first curved contact portion extends toward the metallic shell and effectively contacts the metallic shell, and the second curved contact portion extends toward the ground terminal and effectively contacts the ground terminal.

20 Claims, 11 Drawing Sheets

(56) References Cited

U.S. PATENT DOCUMENTS

| | | | | |
|---|---|---|---|---|
| 10,103,492 | B2 * | 10/2018 | Ju | H01R 24/60 |
| 10,109,966 | B2 * | 10/2018 | Tsai | H01R 13/502 |
| 10,116,100 | B2 * | 10/2018 | Feng | H01R 13/6597 |
| 10,297,954 | B2 * | 5/2019 | Tsai | H01R 13/502 |
| 10,553,998 | B2 * | 2/2020 | Tsai | H01R 24/60 |
| 2015/0288107 | A1 * | 10/2015 | Wu | H01R 13/6593 439/357 |
| 2017/0194754 | A1 * | 7/2017 | Tsai | H01R 24/60 |
| 2018/0026410 | A1 * | 1/2018 | Tsai | H01R 13/6587 439/607.09 |
| 2019/0058298 | A1 * | 2/2019 | Tsai | H01R 13/6581 |
| 2019/0334299 | A1 * | 10/2019 | Tsai | H01R 24/60 |
| 2020/0014158 | A1 * | 1/2020 | Chien | H01R 13/6581 |
| 2020/0112129 | A1 * | 4/2020 | Liu | H01R 13/502 |

* cited by examiner

ELECTRICAL PLUG CONNECTOR WITH GROUNDING MEMBERS HAVING INTEGRATED FIRST AND SECOND CURVED CONTACT PORTIONS FOR EFFECTIVE GROUND CONNECTIONS

CROSS-REFERENCES TO RELATED APPLICATIONS

This application claims the benefit of U.S. provisional application Ser. No. 62/975,793, filed on Feb. 13, 2020 and claims the priority of Patent Application No. 110200221 filed in Taiwan, R.O.C. on Jan. 7, 2021. The entirety of the above-mentioned patent applications are hereby incorporated by references herein and made a part of the specification.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a USB type-C electrical connector known to the inventor(s) are totally different from those of a USB electrical connector known to the inventor(s). A USB type-C electrical receptacle connector known to the inventor(s) includes a one-piece primary plastic core, upper-row plug terminals and lower-row plug terminals held on the primary plastic core, secondary plastic cores respectively assembled with the upper-row plug terminals and the lower-row plug terminals, a hook member between the upper-row plug terminals and the lower-row plug terminals, an outer iron shell circularly enclosing the primary plastic core and the secondary plastic cores, and conductive pieces on the primary plastic core and the secondary plastic cores.

SUMMARY OF THE INVENTION

In general, the components of a USB type-C electrical plug connector known to the inventor(s) are respectively individual elements, and these components are manufactured through complicated production and assembling steps. As a result, during the production and assembly of components, defect products would be produced easily. Furthermore, in the USB type-C electrical plug connector known to the inventor(s), the conductive sheet has a V-shaped elastic arm for contacting the ground plug terminal and the outer iron shell; however, the elastic arm in V-shaped may have unstable conduction and contact to other components easily.

In view of these, according to one or some embodiments of the instant disclosure, an electrical plug connector is provided. The electrical plug connector comprises a metallic shell, an insulated member, a plurality of plug terminals, and two grounding members. The metallic shell comprises a receiving cavity. The insulated member is received in the receiving cavity along an insertion direction. The insulated member defines an insertion cavity and a plurality of through holes. The through holes are formed on two outer surfaces of the insulated member and are in communication with the insertion cavity. The plug terminals are respectively held in an upper inner side and a lower inner side of the insulated member and the insertion cavity defined between the upper inner side and the lower inner side of the insulated member. The two grounding members are respectively assembled at the two outer surfaces of the insulated member. Each of the grounding members comprises at least one side arm, a first curved contact portion, and a second curved contact portion. The at least one side arm, the first curved contact portion and the second curved contact portion are integrally formed as a one-piece member. The first curved contact portion extends toward the metallic shell and contacts the metallic shell. The second curved contact portion extends toward one ground terminal of the plug terminals and contacts the corresponding one ground terminal of the plug terminals.

In one or some embodiments, the first curved contact portion obliquely and outwardly extends from an end portion of the at least one side arm, the second curved contact portion obliquely extends and reversely bends from the first curved contact portion, a cross section of the first curved contact portion and a cross section of the second curved contact portion together form a wavy-shaped elastic arm structure, and a width of the at least one side arm is greater than a width of the first curved contact portion and is greater than a width of the second curved contact portion.

In one or some embodiments, a plurality of molding regions is formed on the two surfaces of the insulated member, and the grounding members are respectively assembled on the molding regions.

In one or some embodiments, each of the grounding members comprises a recessed hole, and each of the recessed holes is formed on the at least one side arm of the corresponding grounding member. When forming the insulated member by injection molding, protrusions are formed at the corresponding recessed holes.

In one or some embodiments, each of the grounding members comprises a positioning arm, and each of the positioning arms outwardly and obliquely extends from a side portion of the corresponding grounding member.

In one or some embodiments, the insulated member comprises a first insulated housing and a second insulated housing symmetrically assembled with each other, the first insulated housing comprises a first inner assembling space, the second insulated housing comprises a second inner assembling space, and the first inner assembling space and the second inner assembling space together form the insertion cavity.

In one or some embodiments, the plug terminals comprise a plurality of first plug terminals and a plurality of second plug terminals, the electrical plug connector further comprises a first assembling block and a second assembling block, the first assembling block is assembled with the first plug terminals and in the first inner assembling space of the first insulated housing, and the second assembling block is assembled with the second plug terminals and in the second inner assembling space of the second insulated housing.

In one or some embodiments, each of the first plug terminals comprises a first flexible contact portion, a first body portion, and a first tail portion, the first body portions of the first plug terminals are held in the first assembling block, and the second curved contact portion of one of the grounding members contacts the first body portion of the first plug terminal located at a side portion of the first assembling block. Moreover, for each of the first plug terminals, the first flexible contact portion extends toward the insertion cavity from one of two ends of the first body portion, and the first tail portion extends out of the first assembling block from the other end of the first body portion.

In one or some embodiments, each of the second plug terminals comprises a second flexible contact portion, a second body portion, and a second tail portion, the second body portions of the second plug terminals are held in the second assembling block, and the second curved contact portion of one of the grounding members contacts the second body portion of the second plug terminal located at a side portion of the second assembling block. Moreover, for each of the second plug terminals, the second flexible contact portion extends toward the insertion cavity from one of two ends of the second body portion, and the second tail portion extends out of the second assembling block from the other end of the second body portion.

In one or some embodiments, the first assembling block comprises a first groove, the first groove is at a side portion of a first ground terminal of the at least one ground terminal, one of two sides of a first one of the second curved contact portions of the grounding members contacts the first ground terminal, and the other side of the first one of the second curved contact portions of the grounding members corresponds to the first groove, moreover, the second assembling block comprises a second groove, the second groove is at a side portion of a second ground terminal of the at least one ground terminal, one of two sides of a second one of the second curved contact portions of the grounding members contacts the second ground terminal, and the other side of the second one of the second curved contact portions of the grounding members corresponds to the second groove.

In one or some embodiments, the electrical plug connector further comprises a metallic member sandwiched between the first insulated housing and the second insulated housing.

In one or some embodiments, the metallic member further comprises two side latches, two side arm portions of the two side latches respectively extend from two sides of the metallic member along the insertion direction, and a latch portion is at a front portion of the corresponding side arm portion and is inserted into the insertion cavity along a transverse direction perpendicular to the insertion direction.

According to one or some embodiments of the instant disclosure, an electrical plug connector is provided. The electrical plug connector comprises a metallic shell, an insulated member, a plurality of plug terminals, a metallic member, and two grounding members. The metallic shell comprises a receiving cavity. The insulated member is received in the receiving cavity along an insertion direction. The insulated member defines an insertion cavity and a plurality of through holes. The through holes are formed on two outer surfaces of the insulated member and are in communication with the insertion cavity. The plug terminals are respectively held in an upper inner side and a lower inner side of the insulated member and the insertion cavity defined between the upper inner side and the lower inner side of the insulated member. The metallic member is sandwiched in a middle level of the insulated member. The metallic member comprises a metallic plate and two side latches. Two side arm portions of the two side latches respectively extend from two sides of the metallic member along the insertion direction, and a latch portion is at a front portion of the corresponding side arm portion and inserted into the insertion cavity along a transverse direction perpendicular to the insertion direction. The two grounding members are respectively assembled at the two outer surfaces of the insulated member. Each of the grounding members comprises at least one side arm, a first curved contact portion, and a second curved contact portion. The at least one side arm, the first curved contact portion, and the second curved contact portion are integrally formed as a one-piece member. The first curved contact portion extends toward the metallic shell and contacts the metallic shell, and the second curved contact portion extends toward one ground terminal of the plug terminals and contacts the corresponding ground terminal of the plug terminals through the corresponding through hole.

In one or some embodiments, the first curved contact portion obliquely and outwardly extends from an end portion of the at least one side arm, the second curved contact portion obliquely extends and reversely bends from the first curved contact portion, a cross section of the first curved contact portion and a cross section of the second curved contact portion together form a wavy-shaped elastic arm structure, and a width of the at least one side arm is greater than a width of the first curved contact portion and is greater than a width of the second curved contact portion.

In one or some embodiments, a plurality of molding regions is formed on the two surfaces of the insulated member, and the grounding members are respectively assembled on the molding regions.

In one or some embodiments, each of the grounding members comprises a recessed hole, and each of the recessed holes is formed on the at least one side arm of the corresponding grounding member. When forming the insulated member by injection molding, protrusions are formed at the corresponding recessed holes.

In one or some embodiments, each of the grounding members comprises a positioning arm, and each of the positioning arms outwardly and obliquely extends from a side portion of the corresponding grounding member.

In one or some embodiments, the insulated member comprises a first insulated housing and a second insulated housing symmetrically assembled with each other, the first insulated housing comprises a first inner assembling space, the second insulated housing comprises a second inner assembling space, and the first inner assembling space and the second inner assembling space together form the insertion cavity.

According to one or some embodiments of the instant disclosure, an electrical plug connector is provided. The electrical plug connector comprises a metallic shell, an insulated member, a plurality of plug terminals, two side latches, and two grounding members. The metallic shell comprises a receiving cavity. The insulated member is received in the receiving cavity along an insertion direction. The insulated member defines an insertion cavity. The plug terminals are respectively held in an upper inner side and a lower inner side of the insulated member and the insertion cavity defined between the upper inner side and the lower inner side of the insulated member. The two side latches are sandwiched in a middle level of the insulated member and are disposed at two sides of the insulated member. Two side arm portions of the two side latches respectively extend along the insertion direction, and a latch portion is at a front portion of the corresponding side arm portion and is inserted into the insertion cavity along a transverse direction perpendicular to the insertion direction. The two grounding member are respectively assembled at two outer surfaces of the insulated member. Each of the grounding members comprises at least one side arm, a first curved contact portion, and a second curved contact portion. The at least one side arm, the first curved contact portion, and the second curved contact portion are integrally formed as a one-piece member. The first curved contact portion extends toward the metallic shell and contacts the metallic shell. The second curved contact portion extends toward one ground terminal of the plug terminals and contacts the corresponding ground terminal of the plug terminals.

In one or some embodiments, a plurality of through holes is respectively formed on the two outer surfaces of the insulated member along a vertical direction perpendicular to the insertion direction and the transverse direction. The through holes are in communication with the insertion cavity, and the second curved contact portion contacts the corresponding ground terminal through the corresponding through hole.

According to one or some embodiments of the instant disclosure, the grounding members and the insulated member are molded as a one-piece member, thereby reducing the production steps as well as reducing production of defect products. Moreover, the grounding member comprises the side arm, the first curved contact portion, and the second curved contact portion which are integrally formed as a one-piece member, the first curved contact portion extends toward the metallic shell and effectively contacts the metallic shell, and the second curved contact portion extends toward the ground terminal and effectively contacts the ground terminal. Accordingly, when the electrical plug connector is mated with a corresponding electrical receptacle connector, the grounding members of the electrical plug connector contact the EMI conductive sheets of the electrical receptacle connector, so that the conduction and grounding can be achieved, the electronic interference can be prevented, and the noise can be reduced.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
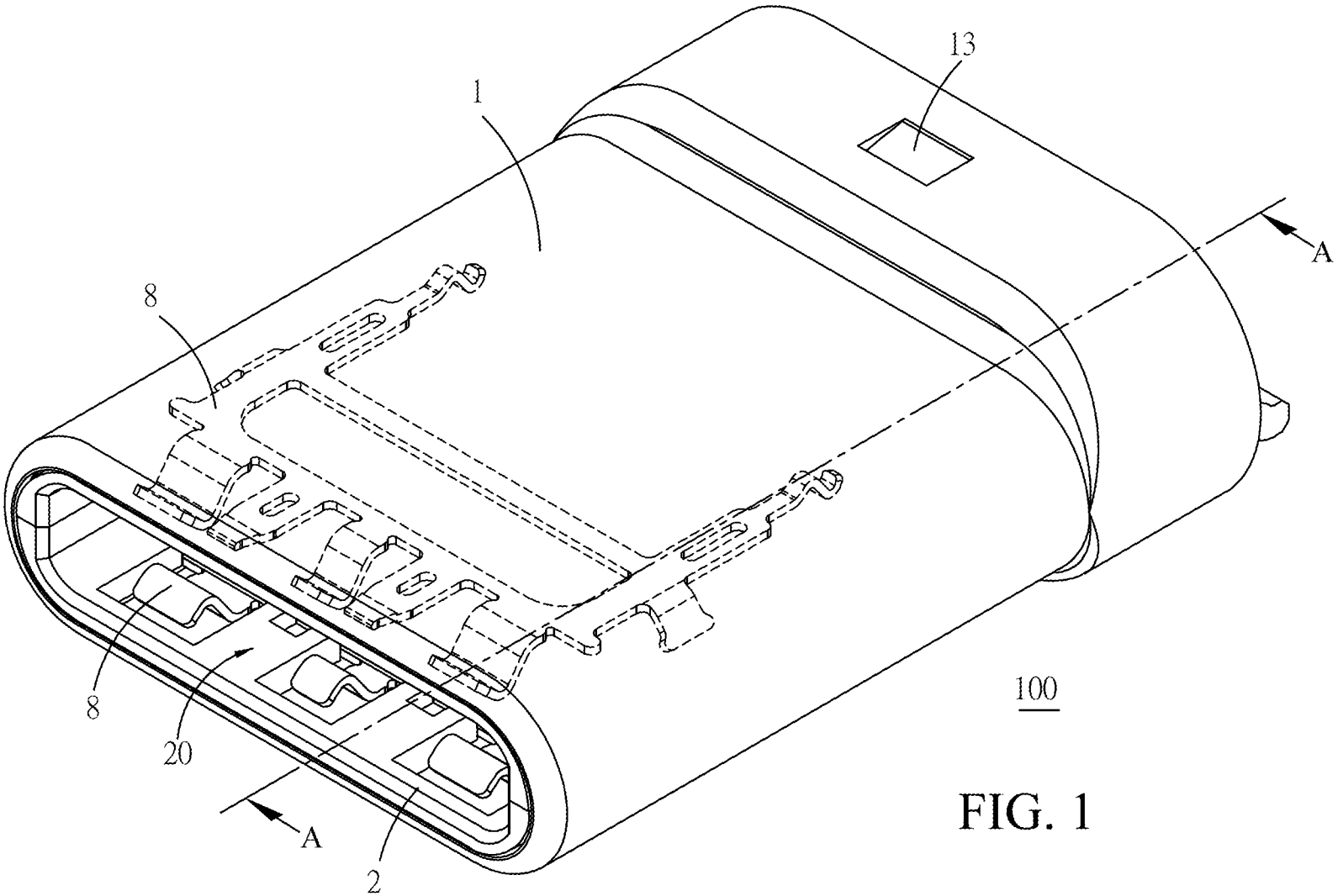
FIG. 1 illustrates a perspective view of an electrical plug connector according to some embodiments of the instant disclosure, where the dash lines are presented to indicate the location of one of the grounding members in the metallic shell.
Figure 2:
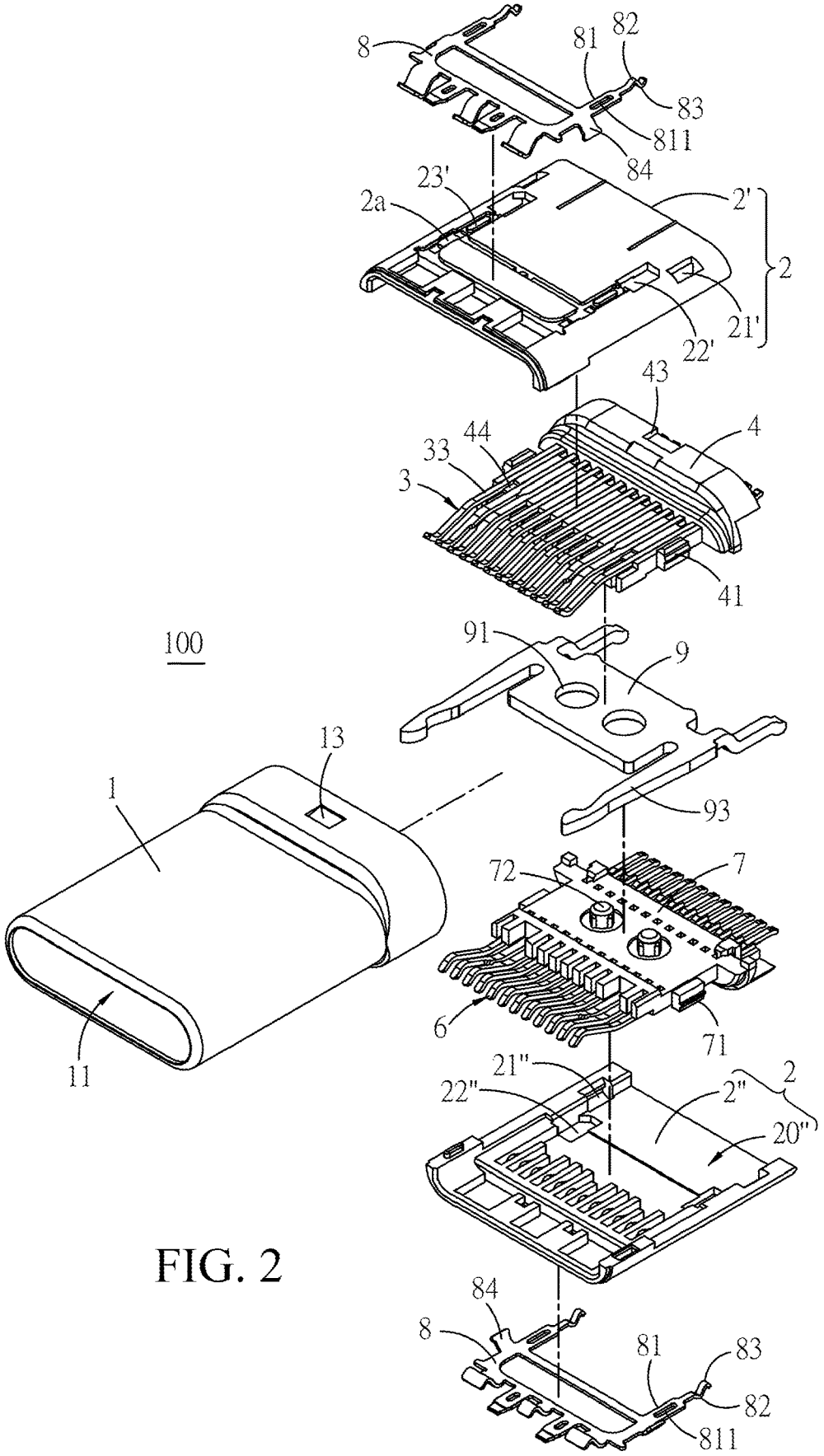
FIG. 2 illustrates a front exploded view of the electrical plug connector according to some embodiments.
Figure 3:
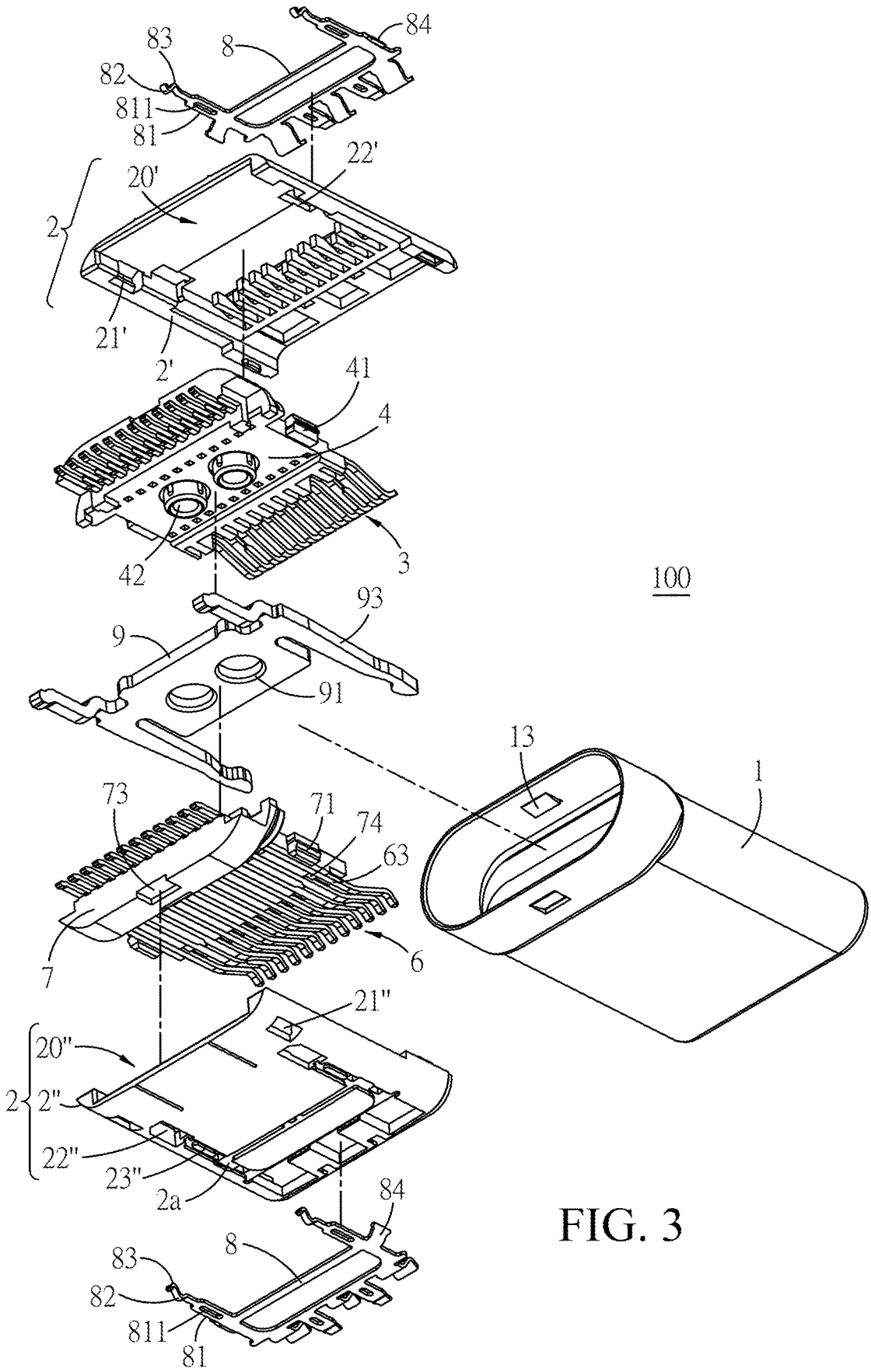
FIG. 3 illustrates a rear exploded view of the electrical plug connector of some embodiments.

Please refer to FIGS. 1 to 3. FIG. 1 illustrates a perspective view of an electrical plug connector 100 according to some embodiments of the instant disclosure, where the dash lines are presented to indicate the location of one of the grounding members 8 in the metallic shell 1. FIG. 2 illustrates a front exploded view of the electrical plug connector 100 according to some embodiments. FIG. 3 illustrates a rear exploded view of the electrical plug connector 100 according to some embodiments. In some embodiments, the electrical plug connector 100 can provide a reversible or dual orientation USB Type-C connector interface or pin assignments, i.e., a USB Type-C plug connector, and the electrical plug connector 100 comprises a metallic shell 1, an insulated member 2, a plurality of plug terminals, and a plurality of grounding members 8. The grounding members 8 also could be used as shielding members. The insulated member 1 may be a one-piece member or may be formed by assembling several components with each other. The plug terminals may be arranged into a single row or into dual rows. The plug terminals comprise first plug terminals 3 and second plug terminals 6.

In some embodiments, the metallic shell 1 comprises a receiving cavity 11.

Figure 8:
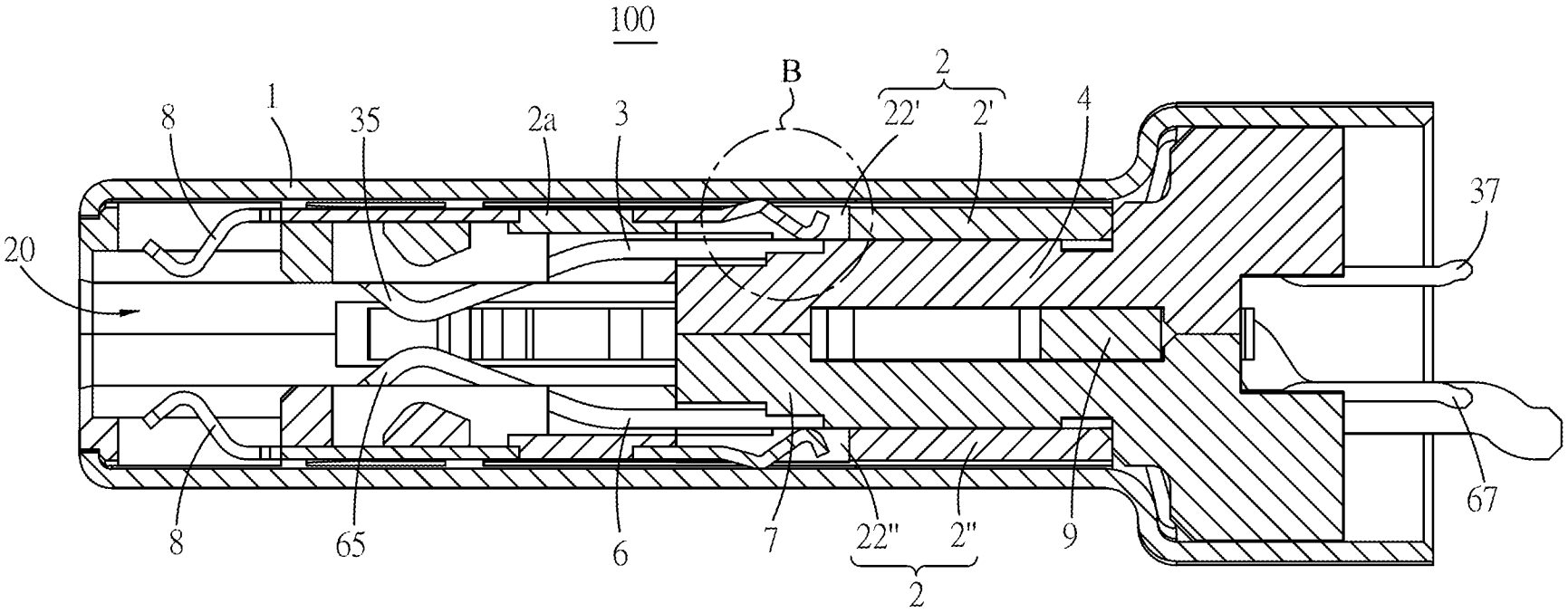
FIG. 8 illustrates a cross-sectional view along line A-A shown in FIG. 1.

In some embodiments, the insulated member 2 is received in the receiving cavity 1 along an insertion direction. The insulated member 2 defines an insertion cavity 20 (as shown in FIG. 8) and a plurality of through holes 22'/22". The through holes 22'/22" are formed on two outer surfaces of the insulated member 2 (the upper surface and the lower surface of the insulated member 2) along a vertical direction perpendicular to the insertion direction and are in communication with the insertion cavity 20.

In some embodiments, the plug terminals are held in the insulated member 2 and are respectively at an upper portion and a lower portion of the inner side of the insulated member 2 and the insertion cavity 20 is defined between the upper portion and the lower portion of the inner side of the insulated member 2. The plug terminals comprise a plurality of signal terminals (e.g., first signal terminals 31 and second signal terminals 61), at least one power terminal (e.g., first power terminals 32 and second power terminals 62), and at least one ground terminal (e.g., first ground terminals 33 and second ground terminals 63).

Figure 11:
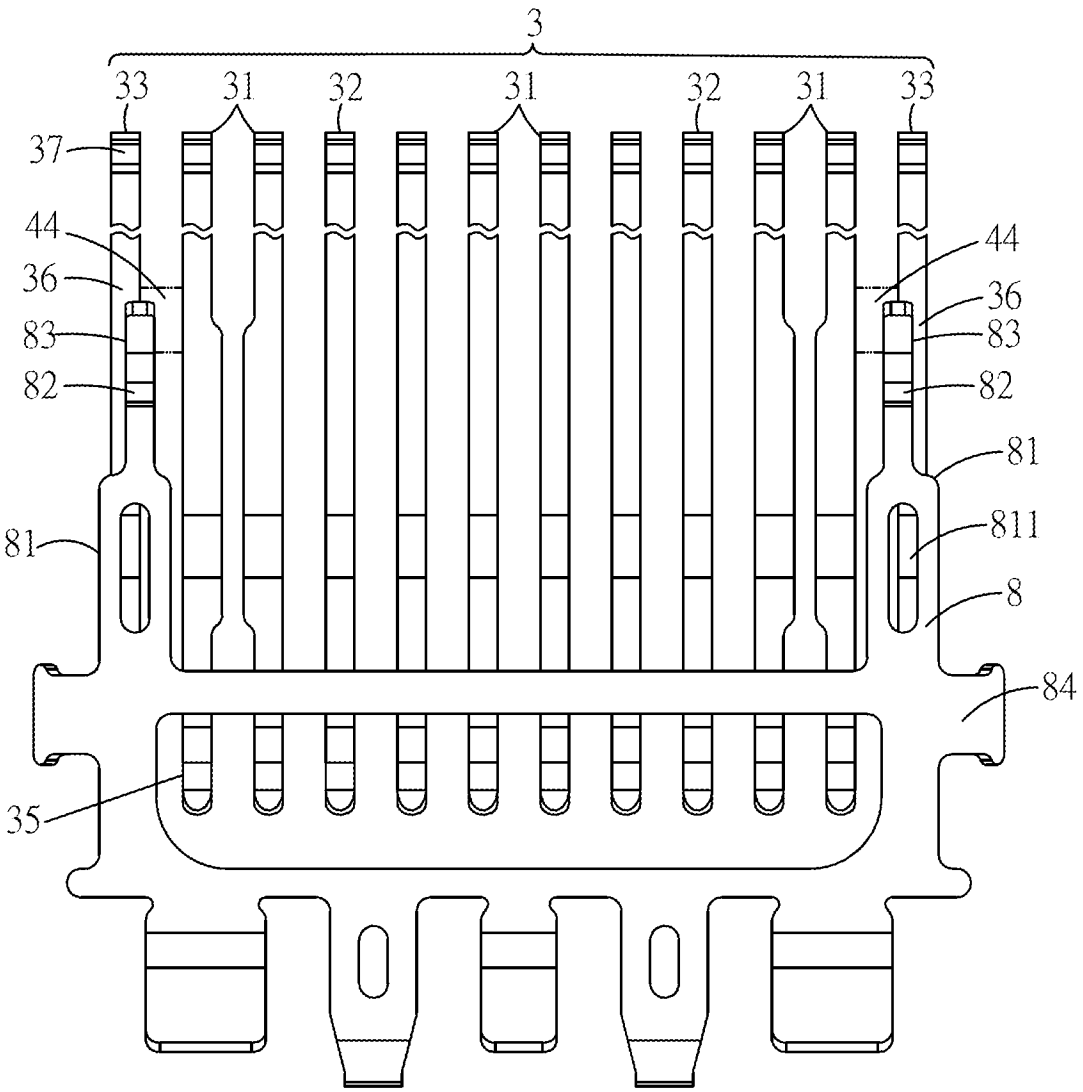
FIG. 11 illustrates a top view of FIG. 10.

In some embodiments, the grounding members 8 are respectively assembled at the two outer surfaces of the insulated member 2 almost along the vertical direction. Each of the grounding members 8 comprises at least one side arm 81, a first curved contact portion 82, and a second curved contact portion 83. The at least one side arm 81, the first curved contact portion 82, and the second curved contact portion 83 are integrally formed as a one-piece member. the first curved contact portion 82 extends toward the metallic shell 1 and contacts the metallic shell 1, and the second curved contact portion 83 extends toward the ground terminal and contacts the ground terminal through the holes formed on the two outer surfaces of the insulated member 2 (the upper surface or the lower surface of the insulated member 2). As shown in FIG. 11, a width of the side arm 81 is greater than a width of the first curved contact portion 82 and is greater than a width of the second curved contact portion 83.

Figure 4:
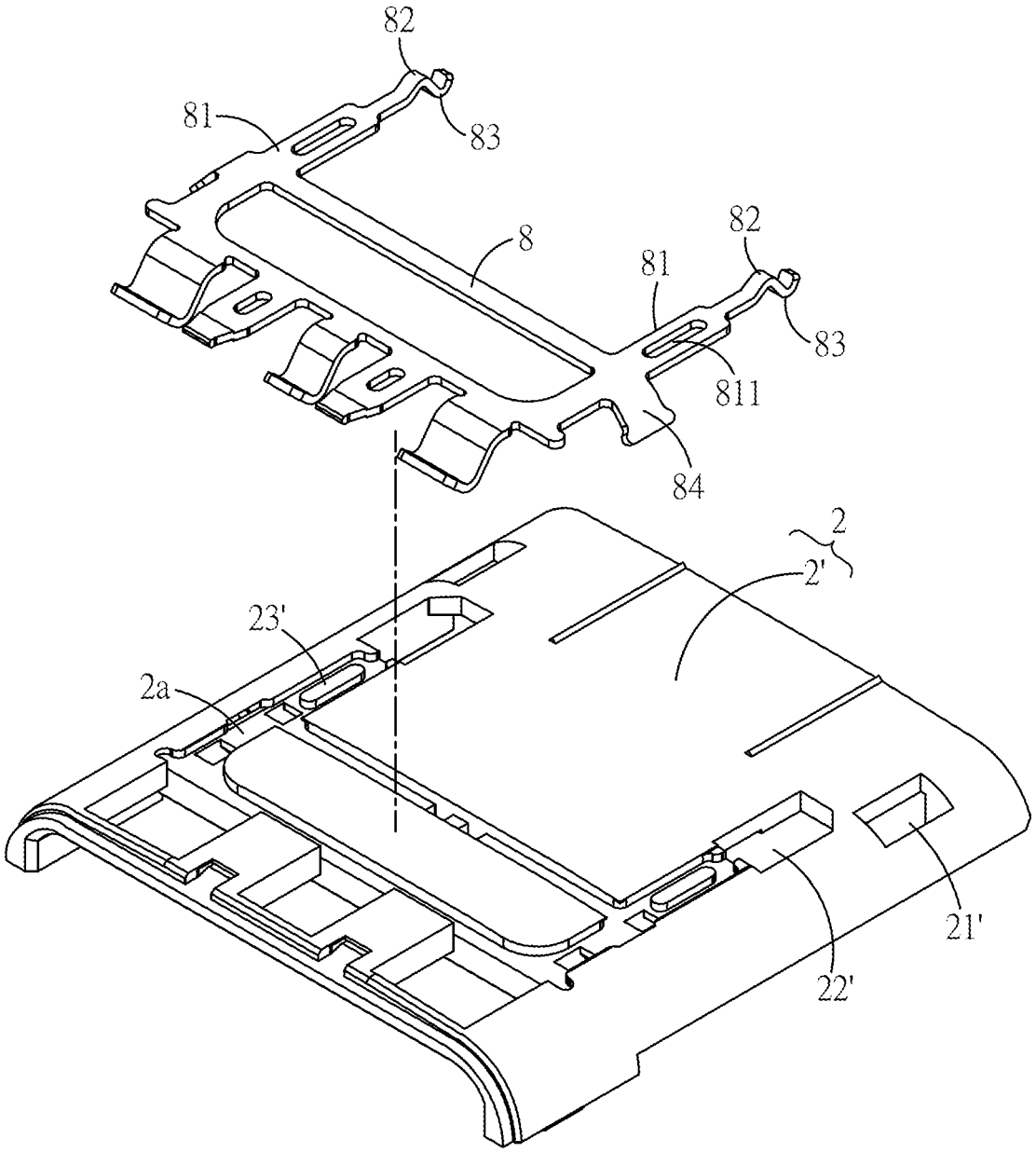
FIG. 4 illustrates an exploded view showing the first insulated housing and the grounding member of the electrical plug connector according to some embodiments.
Figure 5:
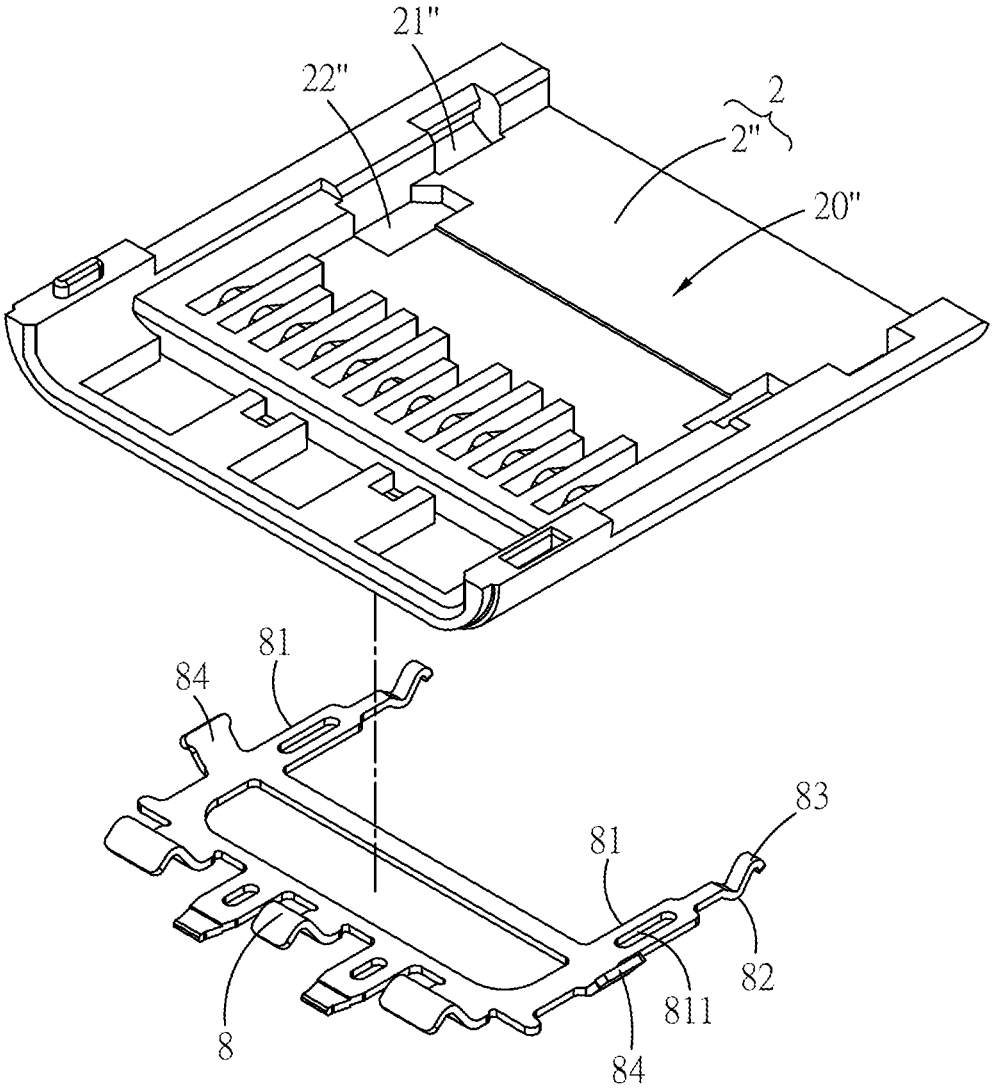
FIG. 5 illustrates an exploded view showing the second insulated housing and the grounding member of the electrical plug connector according to some embodiments.

Please refer to FIGS. 2, 4, and 5. FIG. 4 illustrates an exploded view showing the first insulated housing 2' and the grounding member 8 of the electrical plug connector 100 according to some embodiments. FIG. 5 illustrates an exploded view showing the second insulated housing 2" and the grounding member 8 of the electrical plug connector 100 according to some embodiments. In some embodiments, the first curved contact portion 82 obliquely and outwardly extends from an end portion of the side arm 81, and the second curved contact portion 83 obliquely extends and reversely bends from the first curved contact portion 82. Moreover, a cross section of the first curved contact portion 82 and a cross section of the second curved contact portion 83 together form a wavy-shaped (e.g., N-shaped or S-shaped) elastic arm structure.

Please refer to FIGS. 2, 4, and 5. In some embodiments, a plurality of molding regions 2*a* is formed on the two surfaces of the insulated member 2, and the grounding members 8 are respectively assembled on the molding regions 2*a*. The surfaces of the grounding members 8 are respectively flushed with the two surfaces of the insulated member 2 and are exposed form the two surfaces of the insulated member 2.

Figure 7:
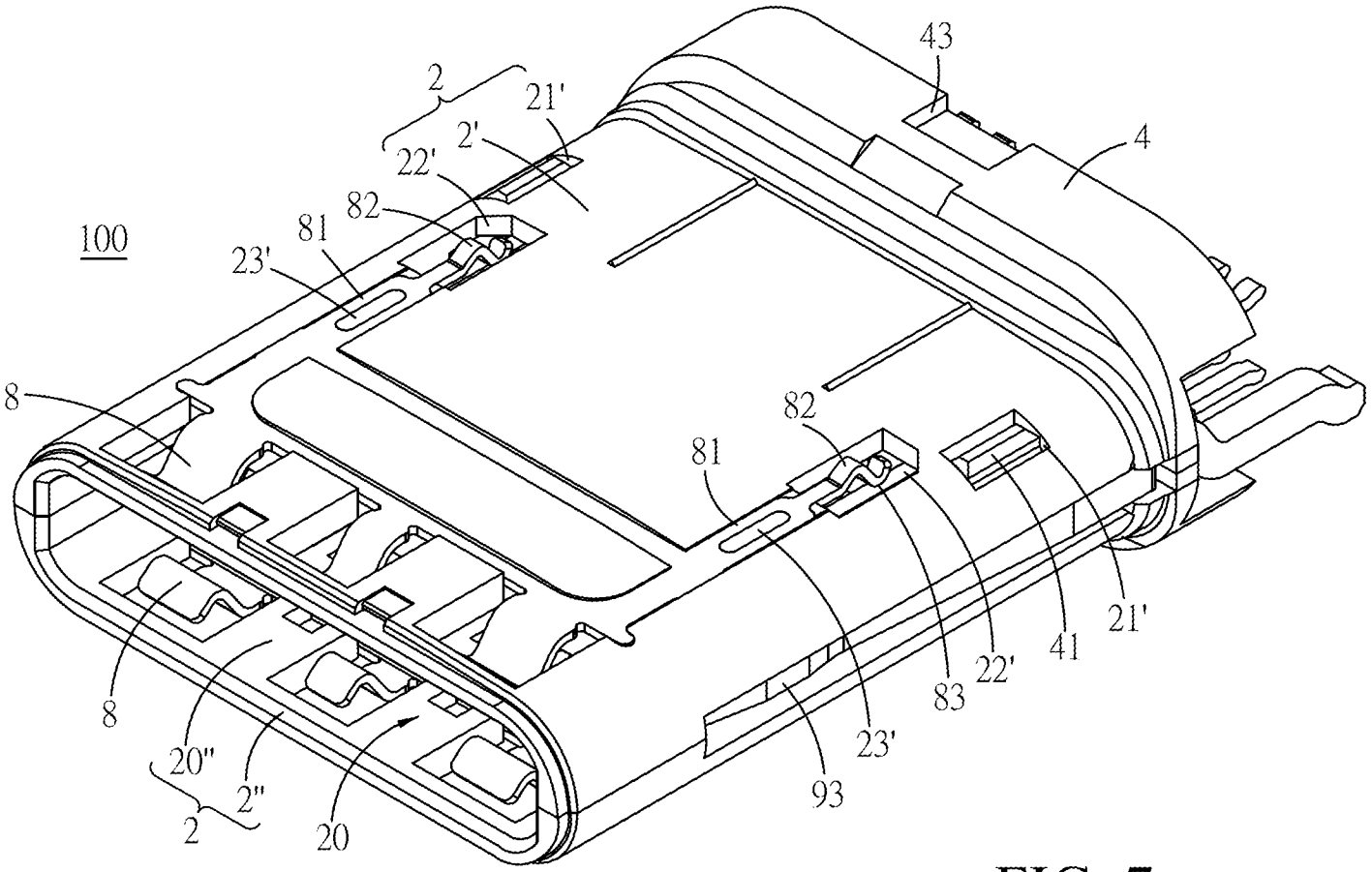
FIG. 7 illustrates a perspective view of the electrical plug connector according to some embodiments, where the metallic shell is not shown.

Please refer to FIGS. 4, 5, 7, and 8. FIG. 7 illustrates a perspective view of the electrical plug connector 100 according to some embodiments, where the metallic shell 1 is not shown. FIG. 8 illustrates a cross-sectional view along line A-A shown in FIG. 1. The grounding members 8 comprise a first grounding member 81 and a second grounding member 82. The first grounding member 81 comprises a plurality of first elastic arms extending into the insertion cavity 20 (as shown in FIG. 8), and the second grounding member 82 comprises a plurality of second elastic arms extending into the insertion cavity 20 (as shown in FIG. 8). During the assembling procedure, the first grounding member 81 is assembled with the first insulated housing 2', and then the first insulated housing 2' is assembled with the first assembling block 4 to form a semi-component along the vertical direction. Similarly, the second grounding member 82 is assembled with the second insulated housing 2", and then the second insulated housing 2" is assembled with the second assembling block 7 to form another semi-component along the vertical direction. Next, the upper semi-component and the lower semi-component are assembled together along the vertical direction and then are received in the metallic shell 1 along the insertion direction.

Please refer to FIGS. 4, 5, 7, and 8. In some embodiments, each of the grounding members 8 comprises a recessed hole 811, and each of the recessed holes 811 is formed on the side arm 81 of the corresponding grounding member 8. When forming the insulated member 2 by injection molding, protrusions 23'/23" are formed at the recessed holes 811 (as shown in FIG. 7), so that the grounding members 8 can be positioned with the insulated member 2 by the protrusions 23'/23" and the recessed holes 811. Each of the grounding members 8 comprises a positioning arm 84, and each of the positioning arms 84 outwardly and obliquely extends from a side portion of the corresponding grounding member 8. When forming the insulated member 2 by injection molding, the positioning arms 84 are embedded into the insulated member 2 (as shown in FIG. 7), so that the grounding members 8 can be positioned with the insulated member 2 by the positioning arms 84.

Please refer to FIGS. 2, 3, 7, and 8. In some embodiments, the metallic shell 1 is a hollowed shell formed by deep drawing techniques. In this embodiment, the metallic shell 1 is a unitary element and is a seamless shell. The metallic shell 1 has a beautiful appearance and improved structural strength. In this embodiment, the metallic shell 1 is a unitary element, but embodiments are not limited thereto. In some embodiments, several pieces may be bent to form the metallic shell 1. Moreover, the upper inner side and the lower inner side of the rear portion of the metallic shell 1 are bent to form buckling pieces 13. The buckling pieces 13 are respectively buckled with corresponding recessed portions 43 of the first assembling block 4 of the first terminal module and corresponding recessed portions 73 of the second assembling block 7 of the second terminal module.

Please refer to FIGS. 2, 3, 7, and 8. In some embodiments, the insulated member 2 comprises a first insulated housing 2' and a second insulated housing 2" symmetrically assembled with each other. The first insulated housing 2' defines a first inner assembling space 20', the second insulated housing 2" defines a second inner assembling space 20", and the first inner assembling space 20' and the second inner assembling space 20" together form the insertion cavity 20.

Figure 6:
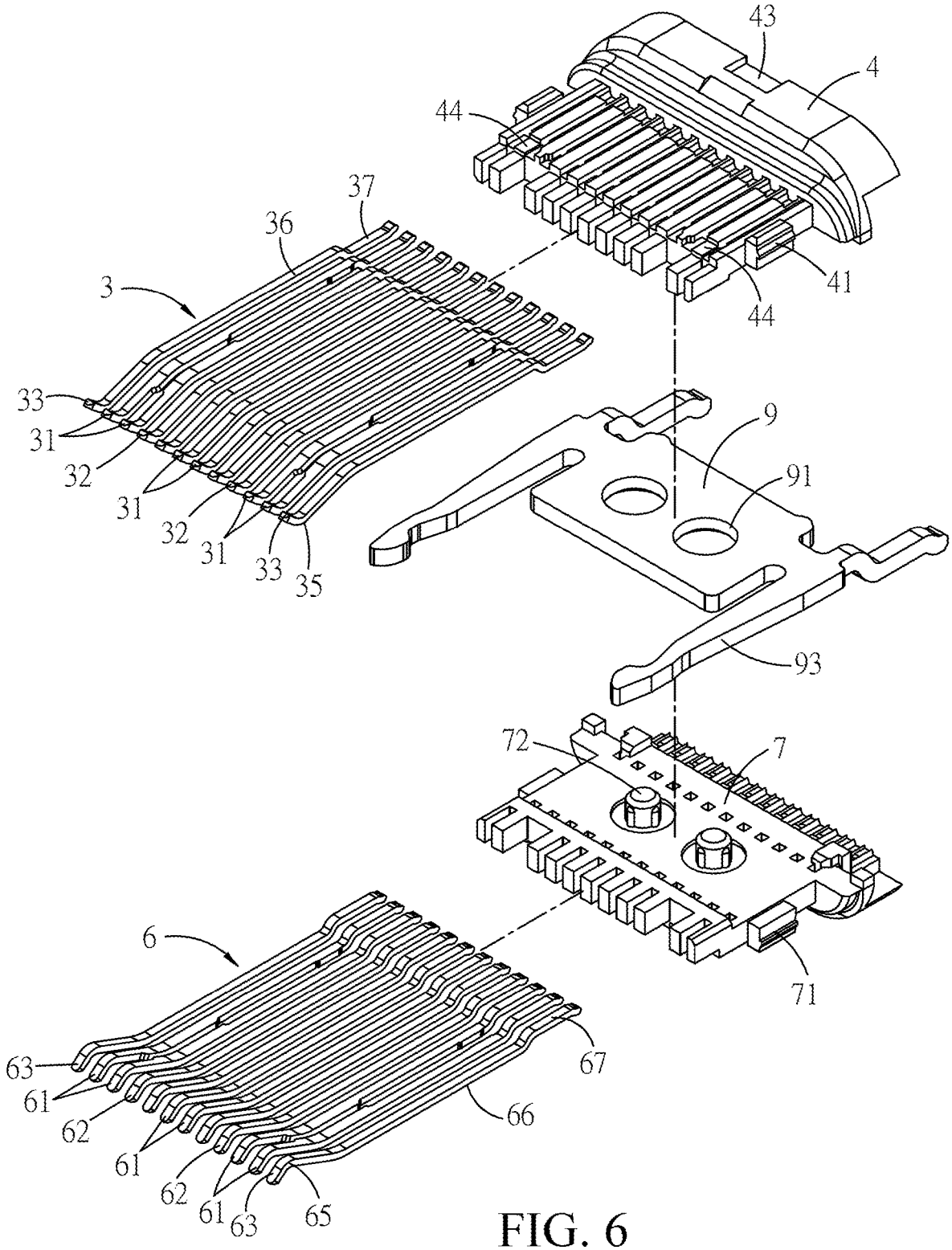
FIG. 6 illustrates an exploded view showing the first assembling block, the first insulated housing, and the grounding member of the electrical plug connector according to some embodiments.

Please refer to FIGS. 2, 3, and 6. FIG. 6 illustrates an exploded view showing the first assembling block 4, the first insulated housing 2', and the grounding member 8 of the electrical plug connector 100 according to some embodiments. In some embodiments, the first terminal module comprises the first plug terminals 3 and the first assembling block 4. The first assembling block 4 is assembled with the first plug terminals 3 and is received in the first inner assembling space 20' of the first insulated housing 2' (e.g., the first assembling block 4 may be at the inner surface of the first insulated housing 2').

Please refer to FIGS. 2, 3, and 6. In some embodiments, the second terminal module comprises the second plug terminals 6 and the second assembling block 7. The second assembling block 7 is assembled with the second plug terminals 6 and is received in the second inner assembling space 20" of the second insulated housing 2" (e.g., the second assembling block 7 may be at the inner surface of the second insulated housing 2").

Please refer to FIGS. 2, 3, and 8. In some embodiments, the first terminal module, the second terminal module, the first insulated housing 2', and the second insulated housing 2" are assembled with each other to form a four-piece assembly, and the insertion cavity 20 is formed between an inner side of the first insulated housing 2' and an inner side of the second insulated housing 2". The first insulated housing 2', the second insulated housing 2", the first terminal module, and the second terminal module are received in the receiving cavity 11 of the metallic shell 1. The first insulated housing 2' assembled with the first terminal module and the second insulated housing 2" assembled with the second terminal module are then assembled with each other and assembled in the receiving cavity 11 of the metallic shell 1.

Please refer to FIGS. 2, 3, and 8. In some embodiments, the first terminal module comprises the first plug terminals 3 and the first assembling block 4 combined with each other to form a one-piece member by injection molding (or by insert-molding), thereby forming the first part of the assembly, and then the first part is further assembled with the first insulated housing 2' (the second part of the assembly). Likewise, the second terminal module comprises the second plug terminals 6 and the second assembling block 7 combined with each other to form a one-piece member by injection molding (or by insert-molding), thereby forming the third part of the assembly, and then the third part is further assembled with the second insulated housing 2" (the fourth part of the assembly).

Please refer to FIGS. 2, 3, and 8. In some embodiments, the first plug terminals 3 and the first assembling block 4 are closely combined with each other, thereby preventing moist from entering into the electrical plug connector 100 from the insertion side at the front portion of the electrical plug connector 100 (as the insertion opening at the left side of the connector shown in FIG. 8), from flowing through the contact portions between the first plug terminals 3 and the first assembling block 4 (as the terminal grooves of the first assembling block 4 shown in FIG. 8), and from flowing into the soldering side at the rear portion of the electrical plug connector 100 (as the first tail portions 37 and the second tail portions 67 at the right side of the connector shown in FIG. 8).

Please refer to FIGS. 2, 3, and 8. In some embodiments, the second plug terminals 6 and the second assembling block 7 are closely combined with each other, thereby preventing moist from entering into the electrical plug connector 100 from the insertion side at the front portion of the electrical plug connector 100 (as the insertion opening of the connector shown in FIG. 8), from flowing through the contact portions between the second plug terminals 6 and the second assembling block 7 (the terminal grooves of the second assembling block 7 shown in FIG. 8), and from flowing into the soldering side at the rear portion of the electrical plug connector 100 (as the first tail portions 37 and the second tail portions 67 at the right side of the connector shown in FIG. 8).

Please refer to FIGS. 2, 3, and 8. In some embodiments, the four parts, that is, first terminal module, the second terminal module, the first insulated housing 2', and the second insulated housing 2" are assembled with each other, and then the assembly is assembled into the metallic shell 1. Accordingly, the assembling components are simplified as the upper semi-component (the assembly of the first part and the second part) and the lower semi-component (the assembly of the third part and the fourth part), and then the upper semi-component and the lower semi-component are assembled into the receiving cavity 11 of the metallic shell 1. Hence, the number of the components for manufacturing the connector can be reduced, thereby simplifying the assembling procedure for the connector. Moreover, it is understood that, in some embodiments, stopping sheets (the stopping sheet may be, but not limited to polyester sheet (Mylar)) respectively provided between the first terminal module and the metallic shell 1 and provided between the second terminal module and the metallic shell 1 for insulation can be omitted, thereby reducing the production of defect products during manufacturing the connector.

Please refer to FIGS. 2, 3, and 8. In some embodiments, the first insulated housing 2' and the second insulated housing 2" are half portions of a tubular structure, respectively. In other words, in some embodiments, the first insulated housing 2' and the second insulated housing 2" each is a half-tubular elongated plate. The upper portion of the insulated member 2 (the first insulated housing 2' and the second insulated housing 2") is symmetrical to the lower portion of the insulated member 2 (the first insulated housing 2' and the second insulated housing 2"), and the left portion of the insulated member 2 (the first insulated housing 2' and the second insulated housing 2") is symmetrical to the right portion of the insulated member 2 (the first insulated housing 2' and the second insulated housing 2"). Moreover, the first insulated housing 2' is combined with the second insulated housing 2" to form the tubular structure, and the insertion cavity 20 is formed inside the tubular structure for mating with an electrical receptacle connector.

Please refer to FIGS. 2, 3, 6, and 8. In some embodiments, the first plug terminals 3 comprise a plurality of first signal terminals 31, at least one power terminal 32, and at least one ground terminal 33. From a front view of the first plug terminals 3, the first plug terminals 3 comprise, from right to left, a ground terminal 33 (Gnd), a first pair of first signal terminals 31 (TX1+−, high-speed differential signal terminals), a power terminal 32 (Power/VBUS), a first function detection terminal (CC1, a terminal for inserting orientation detection of the connector and for cable recognition), a pair of signal terminals 31 (D+−, low-speed differential signal terminals), a first reserved terminal (RFU), another power terminal 32 (Power/VBUS), a second pair of first signal terminals 31 (RX2+−, high-speed differential signal terminals), and another ground terminal 33 (Gnd).

Please refer to FIGS. 2, 3, 6, and 8. In some embodiments, each of the first plug terminals 3 is a bent-type terminal. Each of the first plug terminals 3 comprises a first flexible contact portion 35, a first body portion 36, and a first tail portion 37. In this embodiment, the first body portions 36 are held in the first assembling block 4. The first flexible contact portion 35 extends forward from the first body portion 36 in the rear-to-front direction, and the first tail portion 37 extends backward from the first body portion 36 in the front-to-rear direction and protrudes out of the first assembling block 4. The first flexible contact portion 35 has a curved profile. The first signal terminals 31 extend into the insertion cavity 20 and are provided for transmitting first signals (i.e., USB 3.0 signals or other signals (for example, but not limited to, HDMI signals)). It is understood that, in some embodiments, the number of the first terminals 3 may be reduced for USB 2.0 signal transmission.

Please refer to FIGS. 2, 3, 8, and 9. In some embodiments, the first body portions 36 are held in the first assembling block 4, and the second curved contact portion 83 of one of the grounding members 8 contacts the first body portion 36 of the first plug terminal 3 at a side portion of the first assembling block 4. Similarly, the second body portions 66 are held in the second assembling block 7, and the second curved contact portion 83 of one of the grounding members 8 contacts the second body portion 66 of the second plug terminal 6 at a side portion of the second assembling block 7.

Please refer to FIGS. 2, 3, 6, and 8. In some embodiments, the second plug terminals 6 comprise a plurality of signal terminals 61, at least one power terminal 62, and at least one ground terminal 63. From a front view of the second plug terminals 6, the second plug terminals 6 comprise, from left to right, a ground terminal 63 (Gnd), a first pair of second signal terminals 61 (TX2+–, high-speed differential signal terminals), a power terminal 62 (Power/VBUS), a second function detection terminal (CC2, a terminal for inserting orientation detection of the connector and for cable recognition), a pair of signal terminals 61 (D+–, low-speed differential signal terminals), a second reserved terminal (RFU), another power terminal 62 (Power/VBUS), a second pair of second signal terminals 61 (RX1+–, high-speed differential signal terminals), and another ground terminal 63 (Gnd).

Please refer to FIGS. 2, 3, 6, and 8. In some embodiments, each of the second plug terminals 6 is a bent-type terminal. Each of the second plug terminals 6 comprises a second flexible contact portion 65, a second body portion 66, and a second tail portion 67. In this embodiment, the second body portions 66 are held in the second assembling block 7. The second flexible contact portion 65 extends forward from the second body portion 66 in the rear-to-front direction, and the second tail portion 67 extends backward from the second body portion 66 in the front-to-rear direction and protrudes out of the second assembling block 7. The second flexible contact portion 65 has a curved profile, and the second flexible contact portions 65 correspond to the first flexible contact portions 35. In other words, for example, the first flexible contact portion 35 may be curved inward but the corresponding second flexible contact portion 65 may be curved outward. Each of the first tail portions 37 and the corresponding second tail portion 67 form a clamp for holding and contacting a circuit board. Moreover, the second plug terminals 6 are provided for transmitting second signals (i.e., USB 3.0 signals or other signals (for example, but not limited to, HDMI signals)). It is understood that, in some embodiments, the number of the second plug terminals 6 may be reduced for USB 2.0 signal transmission.

Please refer to FIGS. 2, 3, 6, and 8. In some embodiments, more specifically, the first assembling block 4 is formed with the first plug terminals 3, and the second assembling block 7 is formed with the second plug terminals 6. In this embodiment, the first assembling block 4 is combined with the first body portions 36 by insert-molding, and then the second assembling block 7 is combined with the second body portions 66 by insert-molding. Next, the first assembling block 4 combined with the first plug terminals 3 and the second assembling block 7 combined with the second plug terminals 6 are respectively assembled on the upper portion and the lower portion of a metallic member 9. Thereafter, a semi-product formed by the metallic member 9, the first terminal module, and the second terminal module are assembled into the receiving cavity 11 of the metallic shell 1.

Please refer to FIGS. 2, 3, 6, and 8. In some embodiments, two sides of the first insulated housing 2' comprise two first buckling grooves 21', two sides of the first assembling block 4 comprise two first engaging blocks 41, and each of the first engaging blocks 41 is engaged with the corresponding first buckling groove 21'. Similarly, in some embodiments, two sides of the second insulated housing 2" comprise two second buckling grooves 21", two sides of the second assembling block 7 comprise two second engaging blocks 71, and each of the second engaging blocks 71 is engaged with the corresponding second buckling groove 21".

Please refer to FIGS. 2, 3, 6, and 8. In some embodiments, an inner side of the first assembling block 4 comprises a first positioning structure 42 (the first positioning structure 42 may be a convex structure (i.e., a post structure) or a concave structure (i.e., a hole structure)), an inner side of the second assembling block 7 comprises a second positioning structure 72 (the second positioning structure 72 may be a convex structure (i.e., a post structure) or a concave structure (i.e., a hole structure)), and the first positioning structure 42 is combined with the second positioning structure 72 (a combination of a convex structure and a concave structure). In this embodiment, the first positioning structure 42 has a hole, and the second positioning structure 72 has a block so as to be engaged into the hole.

Please refer to FIGS. 2, 3, 6, and 8. In some embodiments, the electrical plug connector 100 further comprises a metallic member 9, and the metallic member 9 is sandwiched between the first insulated housing 2' and the second insulated housing 2".

Please refer to FIGS. 2, 3, 6, and 8. In some embodiments, the metallic member 9 is formed by blanking techniques, but embodiments are not limited thereto. In some embodiments, the metallic member 9 may be formed by stamping techniques. Moreover, the metallic member 9 further includes two side latches, two side arm portions 93 of two side latches respectively extend from two sides of the metallic member 9 along the rear-to-front direction, i.e. the insertion direction. The middle portion of the metallic member 9 is approximately formed as a rectangular metallic plate and has at least one buckling hole 91. The first positioning structure 42 and the second positioning structure 72 are inserted into the corresponding buckling hole 91, so that the metallic member 9 is sandwiched between the first insulated housing 2' and the second insulated housing 2". In one embodiment, the metallic member 9 is sandwiched in a middle level of the insulated member 2; namely, in this embodiment, the metallic member 9 is sandwiched in the insulated member 2 and is at a middle portion of the insulated member 2.

Please refer to FIGS. 2, 3, 6, and 8. In some embodiments, each of the side arm portions 93 is an elongate latch structure. Moreover, the side arm portions 93 are symmetrical with each other. The side arm portions 93 extend outward from two sides of the metallic member 9 in a same direction, respectively, and the side arm portions 93 are disposed in the two sides of the first insulated housing 2' and the second insulated housing 2" along a transverse direction. The transverse direction is perpendicular to the vertical direction and the insertion direction. Each of the side latches further comprises a latch portion and a leg. Each of the latch portions is at the front portion of the corresponding side arm portion 93 and is inserted into the insertion cavity 20 along the transverse direction. The latch portions and the side latches are provided for latching and contacting a tongue portion of an electrical receptacle connector. Additionally, the latch portions of the side latches are provided for latching and contacting a mid-plate inside a tongue portion of a USB type-C electrical receptacle connector. The metallic member 9 and the two side latches can be a unitary element or the metallic member 9 and the two side latches can be discrete elements. When the electrical plug connector 100 is mated with an electrical receptacle connector, the elastic contact portions of the side arm portions 93 provide a holding function for positioning with the electrical receptacle connector. Moreover, each of the legs extends from the rear portion of the corresponding side arm portion 93, and the legs protrude out of the first insulated housing 2' and the second insulated housing 2" so as to contact the circuit board.

Figure 9:
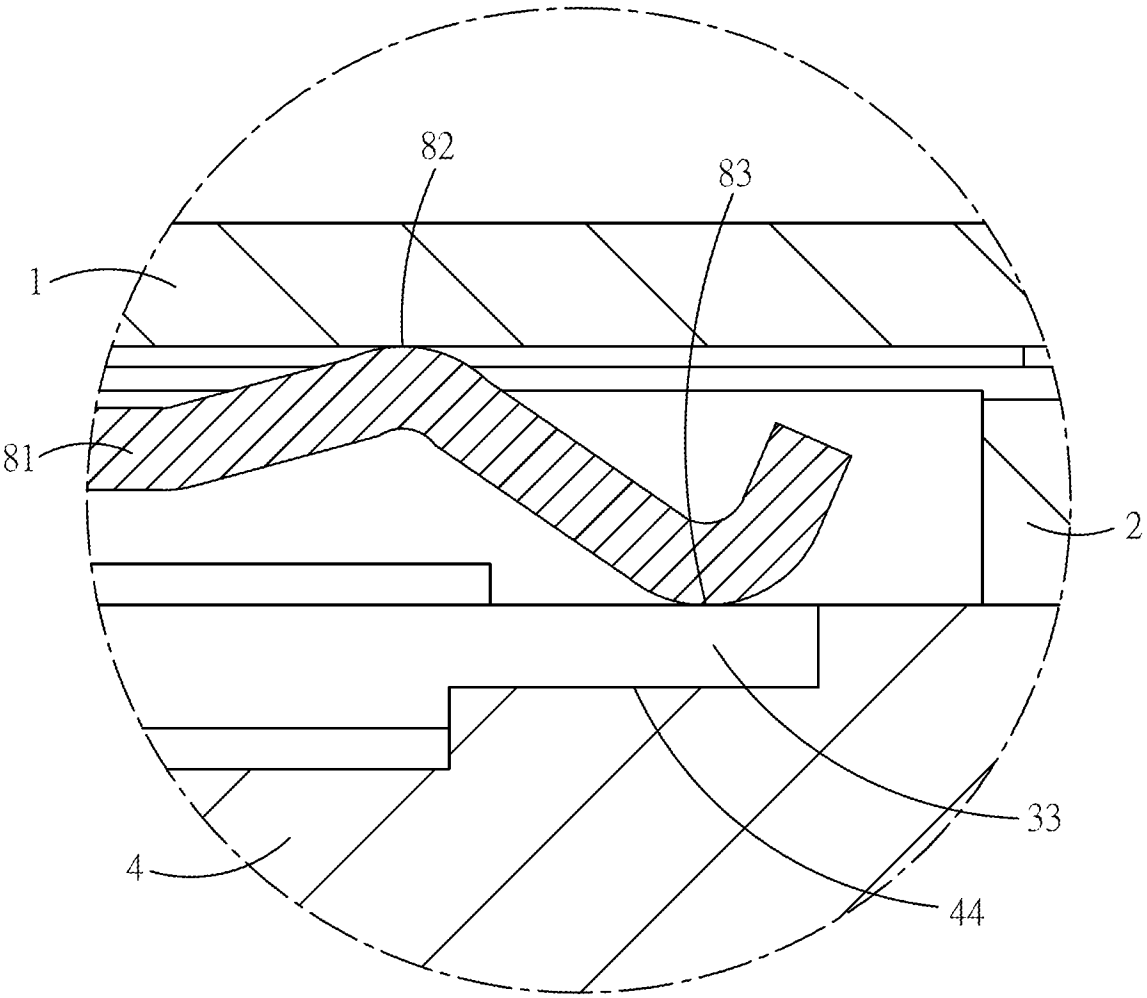
FIG. 9 illustrates an enlarged cross-sectional view of the B portion shown in FIG. 8.
Figure 10:
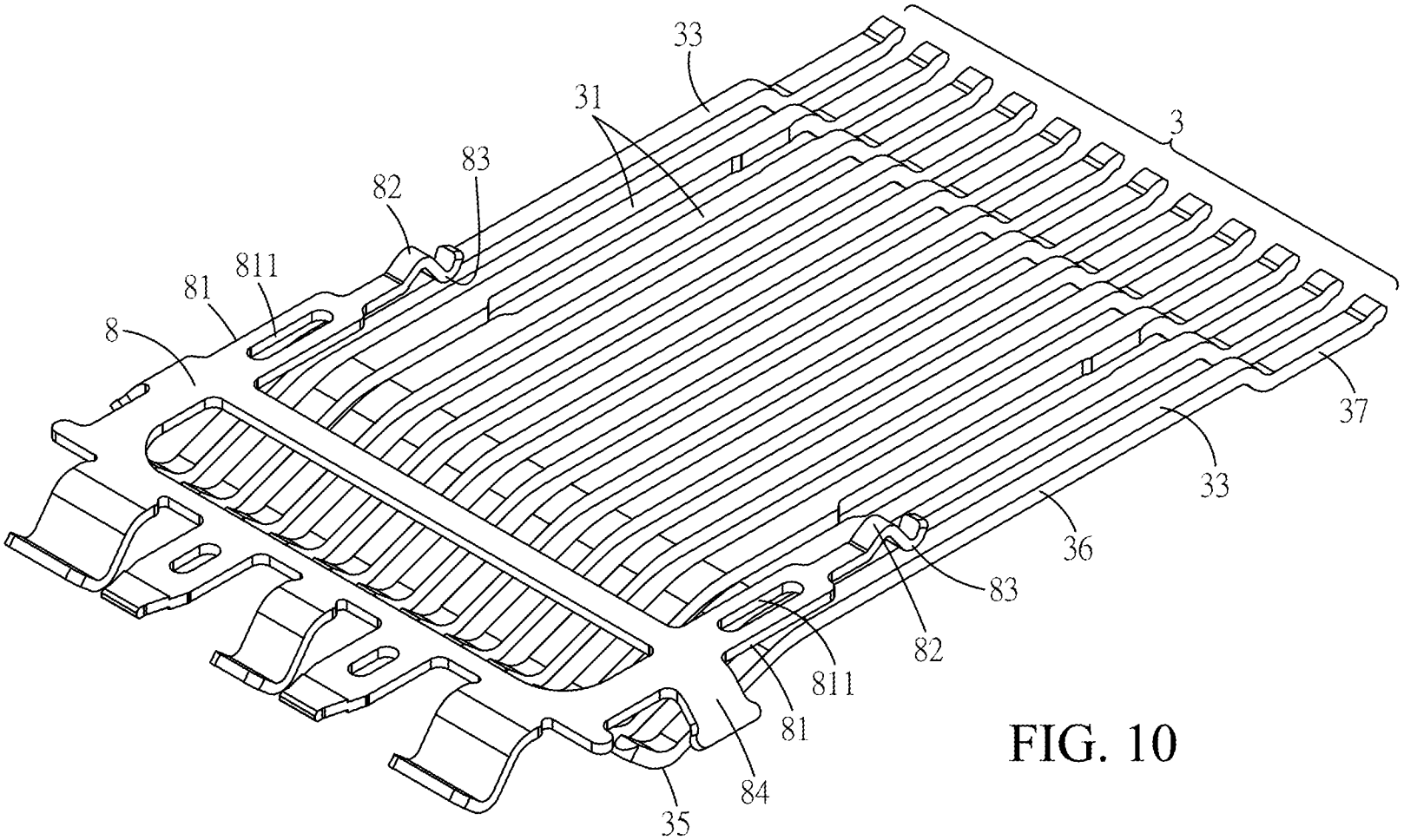
FIG. 10 illustrates a perspective view showing the relative relationship among the grounding members and the first plug terminals of the electrical plug connector according to some embodiments.

Please refer to FIGS. 9 to 11. FIG. 9 illustrates an enlarged cross-sectional view of the B portion shown in FIG. 8. FIG.

10 illustrates a perspective view showing the relative relationship among the grounding members 8 and the first plug terminals 3 of the electrical plug connector 100 according to some embodiments. FIG. 11 illustrates a top view of FIG. 10. In some embodiments, the first assembling block 4 comprises a first groove 44, and the first groove 44 is at a side portion of the first ground terminal 33. One of two sides of the second curved contact portion 83 of the grounding member 8 contacts the first ground terminal 33, and the other side of the second curved contact portion 83 of the grounding member 8 corresponds to the first groove 44 (as shown in FIG. 11, the second curved contact portion 83 is at a middle portion between the first ground terminal 33 and the first groove 44, where the first groove 44 is illustrated by two-dot chain lines). In some embodiments, the second assembling block 7 comprises a second groove 74, and the second groove 74 is at a side portion of the second ground terminal 63. One of two sides of the second curved contact portion 83 of the grounding member 8 contacts the second ground terminal 63, and the other side of the second curved contact portion 83 of the grounding member 8 corresponds to the second groove 74 (as shown in FIG. 3).

According to one or some embodiments of the instant disclosure, the grounding members and the insulated member are molded as a one-piece member, thereby reducing the production steps as well as reducing production of defect products. Moreover, the grounding member comprises the side arm, the first curved contact portion, and the second curved contact portion which are integrally formed as a one-piece member, the first curved contact portion extends toward the metallic shell and effectively contacts the metallic shell, and the second curved contact portion extends toward the ground terminal and effectively contacts the ground terminal. Accordingly, when the electrical plug connector is mated with a corresponding electrical receptacle connector, the grounding members of the electrical plug connector contact the EMI conductive sheets of the electrical receptacle connector, so that the conduction and grounding can be achieved, the electronic interference can be prevented, and the noise can be reduced.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell comprising a receiving cavity;

an insulated member received in the receiving cavity along an insertion direction, wherein the insulated member defines an insertion cavity and a plurality of through holes, the through holes are formed on two outer surfaces of the insulate member and are in communication with the insertion cavity;

a plurality of plug terminals respectively held in an upper inner side and a lower inner side of the insulated member and the insertion cavity defined between the upper inner side and the lower inner side of the insulated member; and two grounding members respectively assembled at the two outer surfaces of the insulated member, wherein each of the grounding members comprises at least one side arm, a first curved contact portion, and a second curved contact portion, the at least one side arm, the first curved contact portion, and the second curved contact portion are integrally formed as a one-piece member, wherein the first curved contact portion extends toward the metallic shell and contacts the metallic shell, and wherein the second curved contact portion extends toward one ground terminal of the plug terminals and contacts the corresponding ground terminal of the plug terminals.

2. The electrical plug connector according to claim 1, wherein the first curved contact portion obliquely and outwardly extends from an end portion of the at least one side arm, the second curved contact portion obliquely extends and reversely bends from the first curved contact portion, a cross section of the first curved contact portion and a cross section of the second curved contact portion together form a wavy-shaped elastic arm structure, and a width of the at least one side arm is greater than a width of the first curved contact portion and is greater than a width of the second curved contact portion.

3. The electrical plug connector according to claim 1, wherein a plurality of molding regions is formed on the two surfaces of the insulated member, and the grounding members are respectively assembled on the molding regions.

4. The electrical plug connector according to claim 1, wherein each of the grounding members comprises a recessed hole, each of the recessed holes is formed on the at least one side arm of the corresponding grounding member, and wherein when forming the insulated member by injection molding, protrusions are formed at the corresponding recessed holes.

5. The electrical plug connector according to claim 1, wherein each of the grounding members comprises a positioning arm, and each of the positioning arms outwardly and obliquely extends from a side portion of the corresponding grounding member.

6. The electrical plug connector according to claim 1, wherein the insulated member comprises a first insulated housing and a second insulated housing symmetrically assembled with each other, the first insulated housing comprises a first inner assembling space, the second insulated housing comprises a second inner assembling space, and the first inner assembling space and the second inner assembling space together form the insertion cavity.

7. The electrical plug connector according to claim 6, wherein the plug terminals comprise a plurality of first plug terminals and a plurality of second plug terminals, the electrical plug connector further comprises a first assembling block and a second assembling block, the first assembling block is assembled with the first plug terminals and in the first inner assembling space of the first insulated housing, and the second assembling block is assembled with the second plug terminals and in the second inner assembling space of the second insulated housing.

8. The electrical plug connector according to claim 7, wherein each of the first plug terminals comprises a first flexible contact portion, a first body portion, and a first tail portion, the first body portions of the first plug terminals are held in the first assembling block, the second curved contact portion of one of the grounding members contacts the first body portion of the first plug terminal located at a side portion of the first assembling block, and wherein for each of the first plug terminals, the first flexible contact portion extends toward the insertion cavity from one of two ends of the first body portion, and the first tail portion extends out of the first assembling block from the other end of the first body portion.

9. The electrical plug connector according to claim 7, wherein each of the second plug terminals comprises a second flexible contact portion, a second body portion, and a second tail portion, the second body portions of the second plug terminals are held in the second assembling block, the second curved contact portion of one of the grounding members contacts the second body portion of the second plug terminal located at a side portion of the second assembling block, and wherein for each of the second plug terminals, the second flexible contact portion extends toward the insertion cavity from one of two ends of the second body portion, and the second tail portion extends out of the second assembling block from the other end of the second body portion.

10. The electrical plug connector according to claim 7, wherein the first assembling block comprises a first groove, the first groove is at a side portion of a first ground terminal of the at least one ground terminal, one of two sides of a first one of the second curved contact portions of the grounding members contacts the first ground terminal, and the other side of the first one of the second curved contact portions of the grounding members corresponds to the first groove, and wherein the second assembling block comprises a second groove, the second groove is at a side portion of a second ground terminal of the at least one ground terminal, one of two sides of a second one of the second curved contact portions of the grounding members contacts the second ground terminal, and the other side of the second one of the second curved contact portions of the grounding members corresponds to the second groove.

11. The electrical plug connector according to claim 6, further comprising a metallic member sandwiched between the first insulated housing and the second insulated housing.

12. The electrical plug connector according to claim 11, wherein the metallic member comprises a metallic plate, a two side latches, two side arm portions of the two side latches respectively extend from two sides of the metallic plate along the insertion direction, and a latch portion is at a front portion of the corresponding side arm portion and is inserted into the insertion cavity along a transverse direction perpendicular to the insertion direction.

13. An electrical plug connector, comprising:

a metallic shell comprising a receiving cavity;

an insulated member received in the receiving cavity along an insertion direction, wherein the insulated member defines an insertion cavity and a plurality of through holes, the through holes are formed on two outer surfaces of the insulated member along a vertical direction perpendicular to the insertion direction and are in communication with the insertion cavity;

a plurality of plug terminals respectively held in an upper inner side and a lower inner side of the insulated member and the insertion cavity defined between the upper inner side and the lower inner side of the insulated member;

a metallic member sandwiched in a middle level of the insulated member, wherein the metallic member comprises a metallic plate and two side latches, two side arm portions of the two side latches respectively extend from two sides of the metallic plate along the insertion direction, and a latch portion is at a front portion of the corresponding side arm portion and inserted into the insertion cavity along a transverse direction perpendicular to the insertion direction and the vertical direction; and two grounding members respectively assembled at the two outer surfaces of the insulated member, wherein each of the grounding members comprises at least one side arm, a first curved contact portion, and a second curved contact portion, the at least one side arm, the first curved contact portion, and the second curved contact portion are integrally formed as a one-piece member, wherein the first curved contact portion extends toward the metallic shell and contacts the metallic shell, and wherein the second curved contact portion extends toward one ground terminal of the plug terminals and contacts the corresponding ground terminal of the plug terminals through the corresponding through hole.

14. The electrical plug connector according to claim 13, wherein the first curved contact portion obliquely and outwardly extends from an end portion of the at least one side arm, the second curved contact portion obliquely extends and reversely bends from the first curved contact portion, a cross section of the first curved contact portion and a cross section of the second curved contact portion together form a wavy-shaped elastic arm structure, and a width of the at least one side arm is greater than a width of the first curved contact portion and is greater than a width of the second curved contact portion.

15. The electrical plug connector according to claim 13, wherein a plurality of molding regions is formed on the two surfaces of the insulated member, and the grounding members are respectively assembled on the molding regions.

16. The electrical plug connector according to claim 13, wherein each of the grounding members comprises a recessed hole, each of the recessed holes is formed on the at least one side arm of the corresponding grounding member, and wherein when forming the insulated member by injection molding, protrusions are formed at the corresponding recessed holes.

17. The electrical plug connector according to claim 13, wherein each of the grounding members comprises a positioning arm, and each of the positioning arms outwardly and obliquely extends from a side portion of the corresponding grounding member.

18. The electrical plug connector according to claim 13, wherein the insulated member comprises a first insulated housing and a second insulated housing symmetrically assembled with each other, the first insulated housing comprises a first inner assembling space, the second insulated housing comprises a second inner assembling space, and the first inner assembling space and the second inner assembling space together form the insertion cavity.

19. An electrical plug connector, comprising:

a metallic shell comprising a receiving cavity;

an insulated member received in the receiving cavity along an insertion direction, wherein the insulated member defines an insertion cavity;

a plurality of plug terminals respectively held in an upper inner side and a lower inner side of the insulated member and the insertion cavity defined between the upper inner side and the lower inner side of the insulated member;

two side latches sandwiched in a middle level of the insulated member and disposed at two sides of the insulated member, wherein two side arm portions of the two side latches respectively extend along the insertion direction, and a latch portion is at a front portion of the corresponding side arm portion and inserted into the insertion cavity along a transverse direction perpendicular to the insertion direction; and two grounding members respectively assembled at two outer surfaces of the insulated member, wherein each of the grounding members comprises at least one side arm, a first curved contact portion, and a second curved contact portion, the at least one side arm, the first curved contact portion, and the second curved contact portion are integrally formed as a one-piece member, wherein the first curved contact portion extends toward the metallic shell and contacts the metallic shell, and wherein the second curved contact portion extends toward one ground terminal of the plug terminals and contacts the corresponding ground terminal of the plug terminals.

20. The electrical plug connector according to claim 19, wherein a plurality of through holes is respectively formed on the two outer surfaces of the insulated member along a vertical direction perpendicular to the insertion direction and the transverse direction, the through holes are in communication with the insertion cavity and the second curved contact portion contacts the corresponding ground terminal of the plug terminals through the corresponding through hole.

* * * * *